US005476683A

United States Patent [19]

Elvidge et al.

[11] Patent Number: 5,476,683

[45] Date of Patent: Dec. 19, 1995

[54] COATER STARTUP

[75] Inventors: David R. Elvidge; Malcolm K. Smith, both of North Vancouver, Canada

[73] Assignee: MacMillan Bloedel Limited, Vancouver, Canada

[21] Appl. No.: 302,024

[22] Filed: Sep. 12, 1994

[51] Int. Cl.[6] ..... B05D 1/28

[52] U.S. Cl. ..... 427/211; 427/428; 118/696; 118/203; 118/227; 118/262

[58] Field of Search ..... 118/107, 110, 118/203, 227, 262, 249, 696; 427/428, 211, 359

[56] References Cited

U.S. PATENT DOCUMENTS 4,848,268 7/1989 Sollinger et al. ..... 118/227
5,122,396 6/1992 Rantanen ..... 118/262
5,159,893 11/1992 Rantanen ..... 118/227
5,328,511 7/1994 Beisswanger ..... 118/203

*Primary Examiner*—Shrive Beck
*Assistant Examiner*—Katherine A. Bareford
*Attorney, Agent, or Firm*—C. A. Rowley

[57] ABSTRACT

Lubricant is applied to the rolls of the size press to lubricate the rolls prior to moving the coating heads into their coating position by substantially simultaneously applying a lubricating film to each of the rolls of the size press in stripes symmetrically positioned relative to the center line of the web passing through the size press to in stages symmetrically relative to the axis of the web substantially equally increase the surface area of the roll to which the lubricating film is applied until the full surface corresponding to the full width of the web on each of the rolls is lubricated and then a metering rod type coating head apply coating to each of the size press rolls are simultaneously moved into coating position.

12 Claims, 4 Drawing Sheets

COATER STARTUP

FIELD OF INVENTION

The present invention relates to a coating apparatus, more particularly, the present invention relates to a coating apparatus able to coat lightweight base sheets.

BACKGROUND OF THE INVENTION

The use of size presses as coaters wherein a separate coating head applies a uniform thickness coating film to each of the rolls of the size presses and these rolls substantially simultaneously transfer the coating to opposite sides of a web of paper in a nip found between the size press rolls is becoming relatively common practice. For example, size presses of this type using metering rod type coating applicator heads are shown, for example, in U.S. Pat. Nos. 4,848,268 issued Jul. 18, 1989, to Sollinger and 5,159,893 issued Nov. 3, 1992, to Rantanen.

It is also known to use similar system whenever coating is applied to one roll only of a pair of rolls forming a coating nip.

When operating these systems, it is known to apply a lubricating liquid to the coating rolls before the coating head is moved into coating applying position in order to lubricate the surface of the rolls. The roll surfaces are usually formed by a relatively soft material and when the coating head is moved into coating position, metering rods, which meter the output of coating from the head, are pressed against and indent the roll surface, and are rotated at a different peripheral speed than the surface speed of the roll. If no lubricating film is present, the size press rolls are either slowed which in turn generally results in breaking of the paper web or wear or other damage is inflicted on the soft cover of the nip rolls. Generally, water is simply sprayed onto the surface of the roll(s) in an amount to provide the required lubrication.

The above system seems to work satisfactorily when for relatively heavy basis weight paper passing through the nip, i.e. a basis weight paper of over say, about 40 lb per 1,000 $ft^2$. However, when lighter weight base sheets, which are generally less strong, are run through the machine, using exactly the same technique, the paper either deforms significantly resulting in tracking problems (i.e. the correct direction of movement of the web cannot be maintained) or alternatively, in the web breaking.

Generally, when stinting this size press equipment, the procedure is to move the coating heads into a preload condition wherein the metering rod is pressed lightly against the surface of the press roll and almost immediately thereafter, to abruptly increase the pressure to full pressure and force the metering rod into the final position. This procedure, in many cases, has been found to be detrimental to the roll cover and to cause paper breaks.

BRIEF DESCRIPTION OF THE PRESENT INVENTION

It is an object of the present invention to provide an improved method and apparatus for lubricating the surface of metered size press rolls at the commencement of a coating operation.

Broadly, the present invention relates to a method of lubricating the surface of at least one size press roll comprising passing a paper web through a coater nip formed by said at least one size press roll, applying a lubricating liquid to a peripheral surface on said at least one size press roll along areas symmetrically located on opposite sides of an axial center line of said paper web passing through said nip to form on said peripheral surface of said at least one roll film lubricated areas symmetrically located on opposite sides of said axial center line, gradually and symmetrically on opposite sides of said axial center line increasing the total width measured axially of said at least one roll of said lubricated areas until said lubricated areas extend axially of said at least one size press roll a width at least equal to an effective axial length of a coating head for application of a coating to said at least one roll, and then moving said coating head into coating positions against said at least one roll.

Preferably, said at least one roll comprises a pair of size press rolls one forming one side of said nip and the other forming the other side of said nip and said lubricating film areas are symmetrically applied to each of said rolls and each of said pair of press rolls will have its said coating head which is moved into coating relationship with its said size press roll.

Preferably, each said coating head includes a metering rod extending axially of said rolls and defining one side of a metering outlet from its respective said coating head through which coating is applied to said peripheral surface of its respective said roll and wherein said moving comprises a first step of preloading said metering rods against their respective peripheral surface and a second step following said first step and wherein each said rod is pressed against its respective said surface with greater force than when in said preloading position to position said head in final coating position.

Preferably in said second stage pressure applied to said metering rod is gradually increased over a period of at least 5 seconds to move said metering rod into final coating position and coordinated with the rate at which coating fluid is supplied to said coating head to ensure against application of too much coating and disruption of the operation of said at least one roll by application of pressure of said metering rod too quickly.

Preferably, said lubricating liquid is applied in a first stripe extending substantially equally on opposite sides of said axial center line of said web and said width is increased laterally in substantially equal increments and simultaneously on opposite sides of said first stripe until said lubricating film extends substantially said full effective axial length of said coating head on each said roll.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
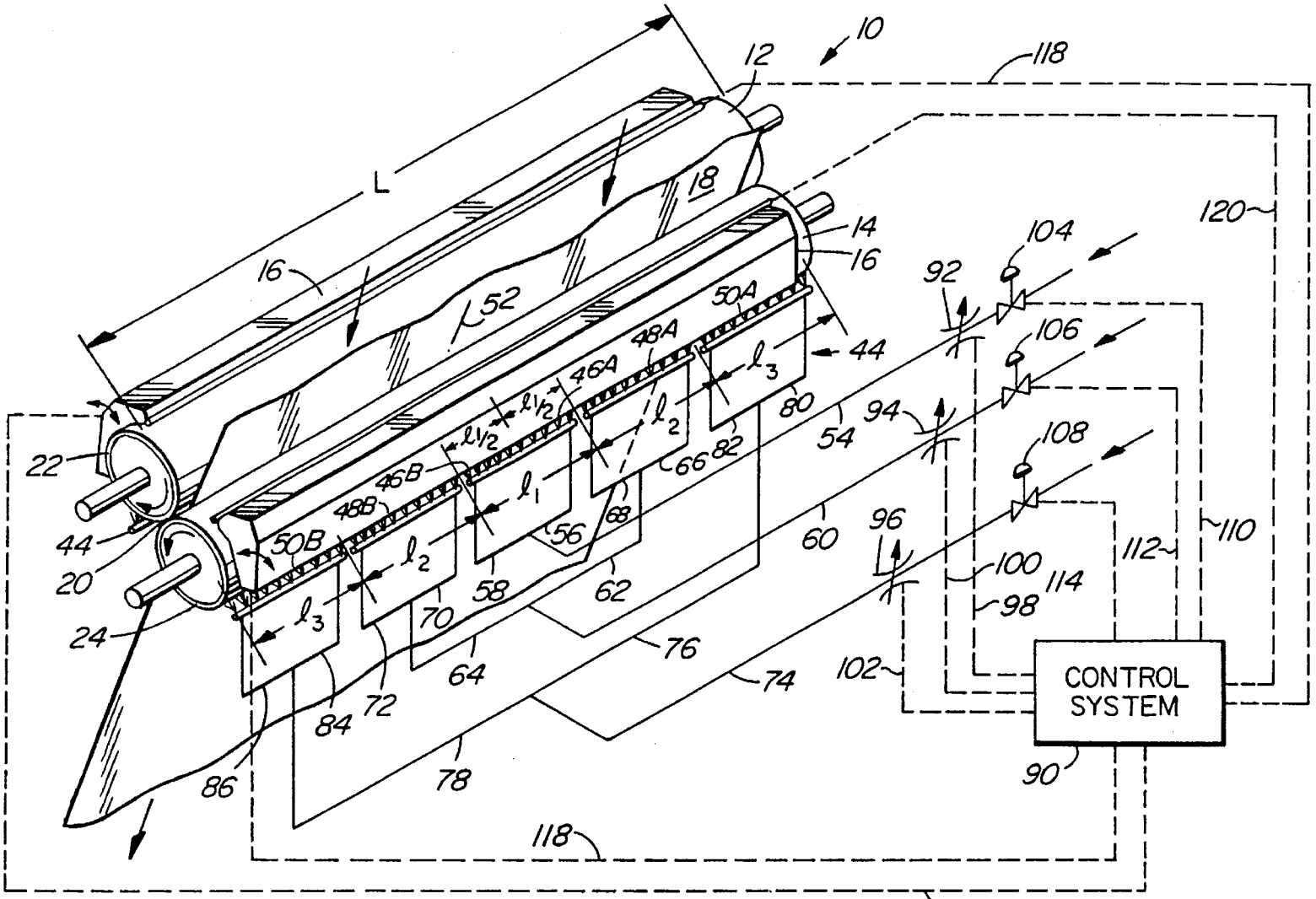
FIG. 1 is a schematic illustration of the lubrication applying system of the present invention.

As shown in FIG. 1, the coater 10 is composed of a pair of size press nip forming rolls 12 and 14, each of which is provided with its respective coating head 16 for applying a coating material to the surfaces of the rolls 12 and 14 for application to a web 18 in the nip 20 formed between the rolls 12 and 14. In some installations, coating is applied to one side only of the web 18, thus, only one roll with a coating head is required to form one side of the nip 20 and the second roll forming nip 20 may be any suitable roll.

As above indicated, on the startup of this equipment, particularly when the web 18 is made of relatively light material and thus, has a relatively lower strength, it is necessary to precondition the surface of the rolls, each of which as indicated at 22 and 24 is formed, as is well known, by a compressible blanket that is slightly compressed within the nip 20 during the application of the coating. Each of the coating heads each generally indicated at 16 are essentially the same, thus, only one will be described and only those portions of the coating head that are manipulated in practising the present invention, will be discussed.

Figure 3:
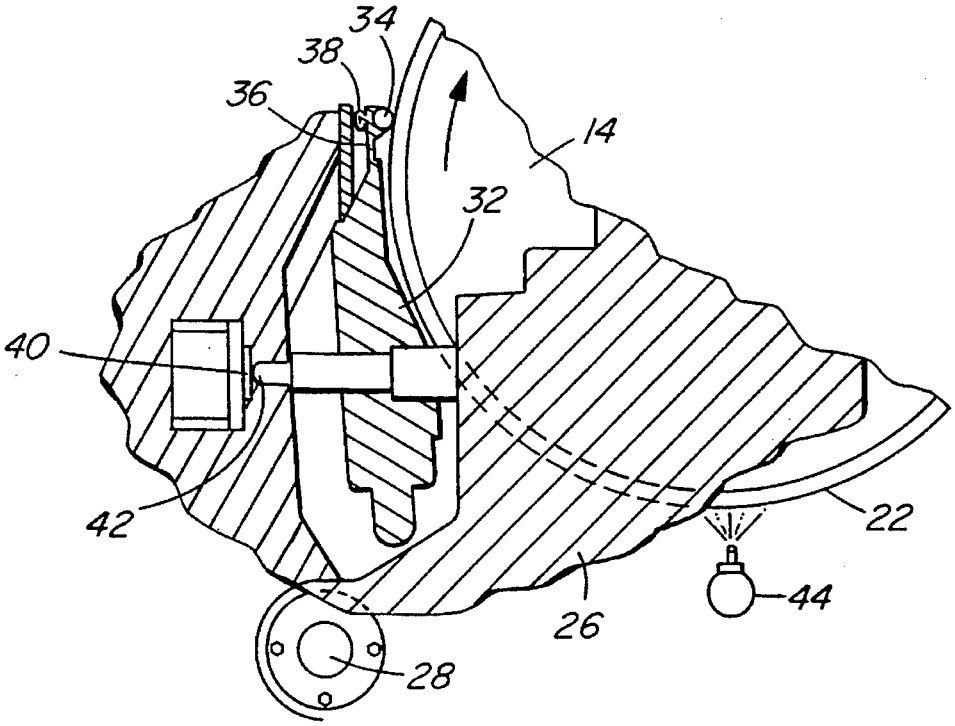
FIG. 3 shows same coating head in a preload position.
Figure 4:
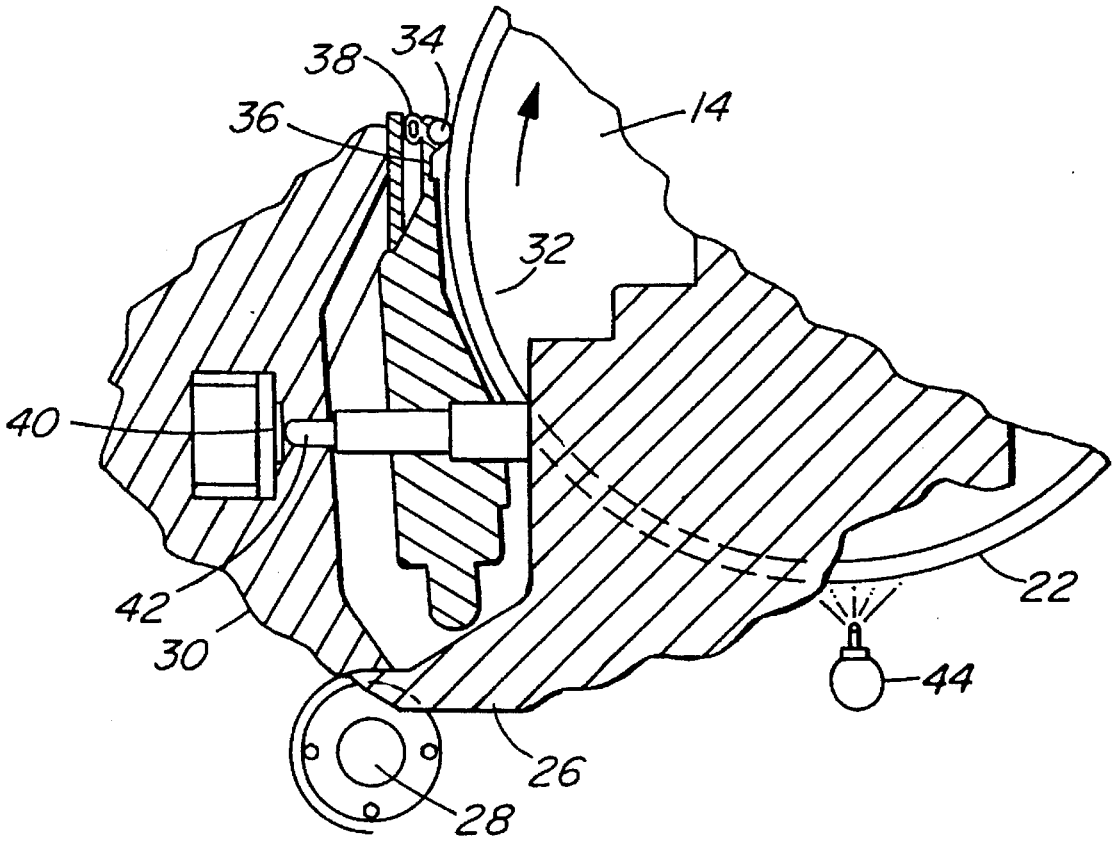
FIG. 4 shows a coating head in coating position.

The coating head 16 is pivotably mounted via its frame 30 to the machine frame 26 via shaft 28. The coating head is indicated at 32 is provided with a metering rod 34 defining one side of its coating outlet. The metering rod 34 bears against the surface of the roll 12 (or 14) and in operative position squeezes the blanket 22 (or 24) as shown in FIGS. 3 and 4, particularly, FIG. 4.

The coating rod or metering rod 34 is mounted on a resilient arm 36 and is biased against the blanket 22 (or 24) forming the surface of the roll 12 (or 16) by inflation of the inflatable tube 38. As will be described below, the tube 38 is inflated to operating pressure after the coating head 32 has been moved into preloading position by moving coating head 32 to position the stop 40 mounted on the frame 30 into a butting relationship with the stop 42 on the machine frame 26.

Mounted on the frame 26 in a position to direct lubricating film onto the surface of each roll 12 (or 16) in a position upstream of the coating head 16 relative to the direction of movement of each of the rolls 12 or 14 into the nip 20 are lubrication film applying systems 44, there being one such system for each roll in the illustrated arrangement.

Each system 44 is composed of a plurality of discrete lubricating film applicators 46, 48 and 50 position substantially in side by side relationship along the axial length of roll 12 or 14 and symmetrically positioned relative to and on opposite sides of the axial center line 52 of the web 18. The corresponding symmetrical portions of each of the lubricating film applicators on the right side of the center line 52 in FIG. 1 are designated by the letter A and those on the left side by the letter B. Thus, the portion of the coating head 48 to the right center line 52 is designated as 48A and the portion forming it symmetrical film applicator located to the left of the center line 52, designated as 48B, etc.

In the illustrated arrangement, the combined width of the applicators 46A and 46B is equal to a length $l_1$ with half as indicated by the dimension $l_1/2$ to the right of the center line 52 and the other half to the left of the center line 52. Each of the applicators 48A and 48B are the same length as indicated by the length $l_2$ and each of the applicators 50A and 50B are essentially the same length as indicated by the length $l_3$.

In the illustrated arrangement, the center applicator 46 is supplied with fluid via the line 54 which is divided into a pair of lines 56 and 58 that supply opposite ends of the applicator 46A, 46B.

The applicators 48A and 48B are fed from a common supply line 60 which in turn is bisected into a pair of feed lines 62 and 64, each of which is in turn divided into a pair of input lines 66 and 68, 70 and 72 respectively to feed opposite ends of the applicator 48A and 48B.

The outside applicator 50 are similarly fed from a header 74 which is bisected into a pair of lines 76 and 78 which in turn are bisected into input lines 80 and 82 and 84 and 86 respectively to feed the applicators 50A and 50B respectively.

It will be apparent that the size of the lines 54 to 86 inclusive will depend on the lengths $l_1$, $l_2$ and $l_3$ which need not be equal, i.e. $l_1$ need not equal $l_2$ which in turn need not equal $l_3$. However, if for the sake of this description, it is assumed that $l_1$ equals $l_2$ equals $l_3$, in which case, it will be apparent that the line 60 and 74 each must deliver twice the amount of fluid as the line 54 which services only a single length.

It will be apparent that if desired, the length $l_1$ could be made equal to twice $l_2$ and twice $l_3$ so that total flow to each of the applicator 46, 48 and 50 would be essentially the same.

It will be noted that each of the applicator 46, 48 and 50 are symmetrical relative to the axial center line 52 which is important to the operation of the present invention.

In the illustrated arrangement, the applicator 46, 48 and 50 have all been shown to be spray applicators. However, any other suitable type of applicators may be used to uniformly and symmetrically relative to center line 52 apply the lubricating film, generally water, to the surface of the roll.

A suitable control computer 90 controls the operation of the coater 10 and is fed with lubricating flow information from the flow meters 92, 94 and 96 in the fluid lines 54, 60 and 74 respectively via the control lines 98, 100, 102 and uses this information to control the flow valves 104, 106 and 108 as indicated where the control lines 100, 112, 114.

For the purposes of the present invention, all the controls, i.e. flow of coating fluid, etc., have not been shown, however, the controls operated when following the present invention have been shown and further include control of the position of the heads 32, i.e. movement from open to close position controlled via the control lines 116 and 118 and control of inflation of the tubes 38 controlled from the computer 90 via control lines 118 and 120.

Figure 2:
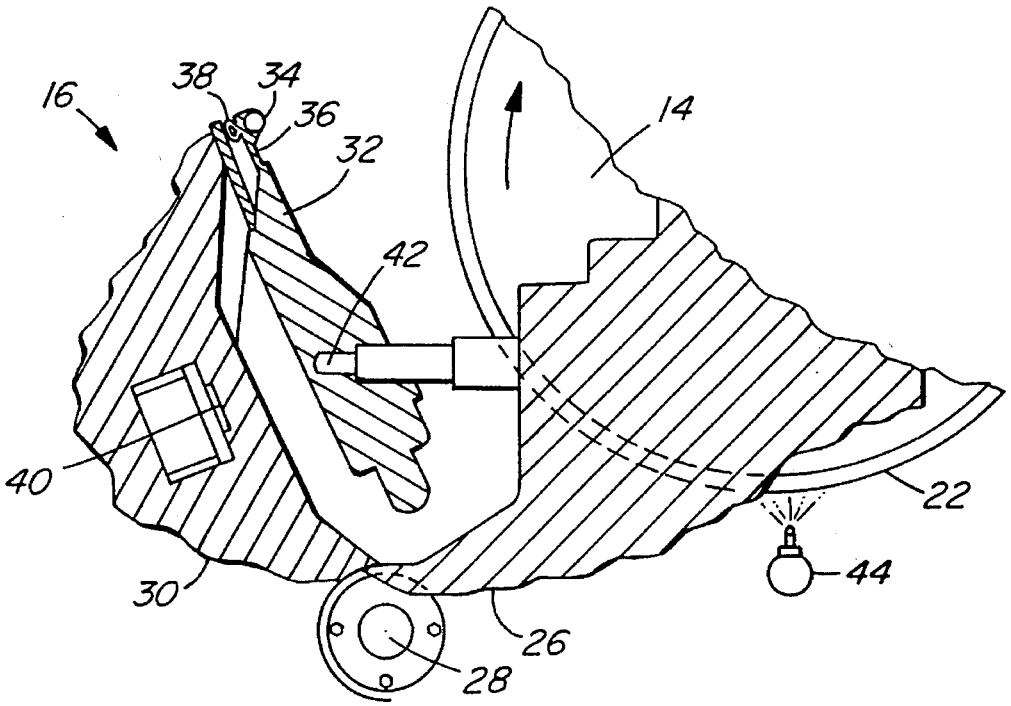
FIG. 2 is a section through a coating head in open position.
Figure 5:
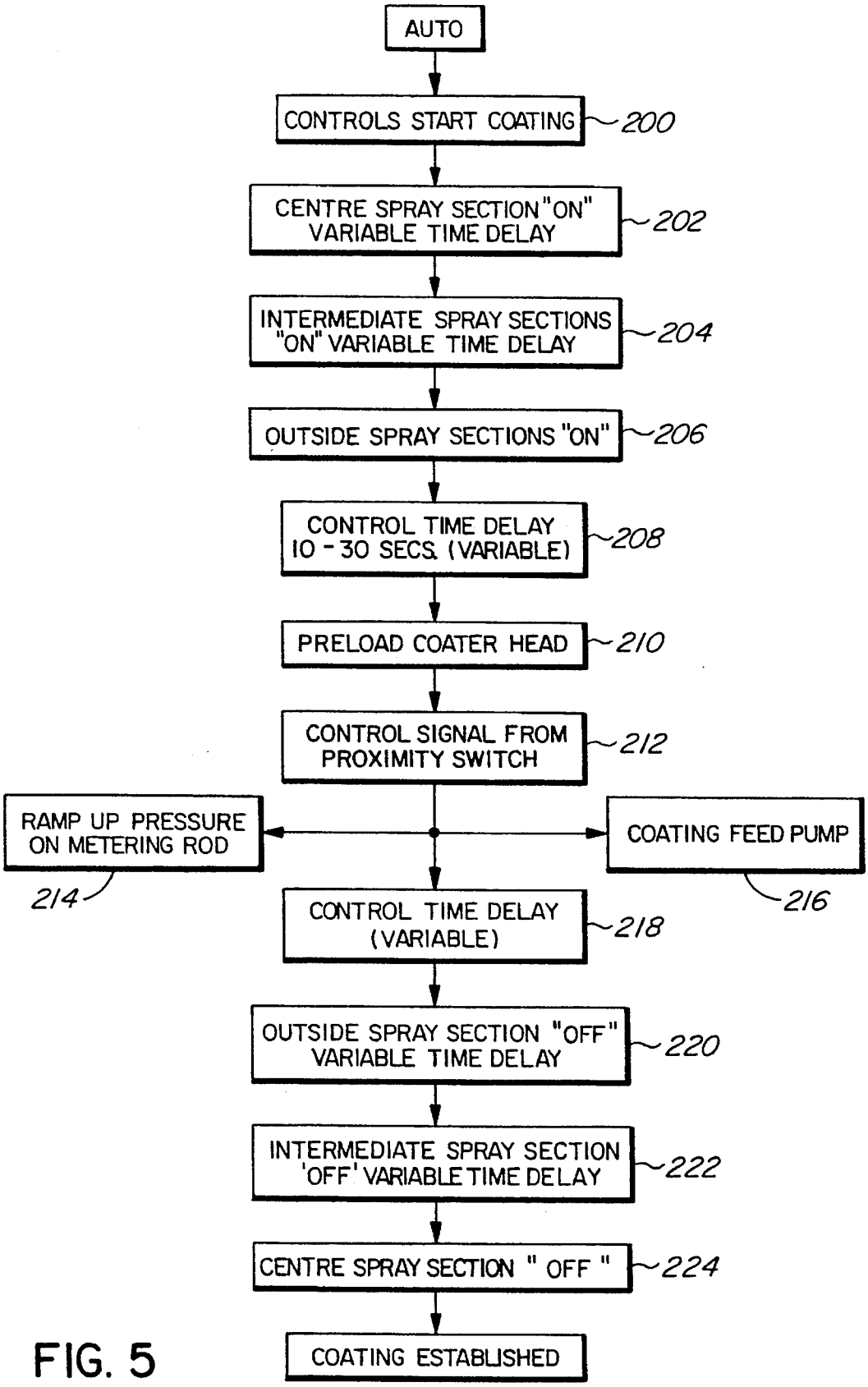
FIG. 5 is a flow diagram illustrating preferred method of startup using the present invention.

The preferred procedure to start the application of coating fluid of the present invention is schematically illustrated in the flow diagram of FIG. 5. The operator initiates the control to start the coating operation as indicated at 200. The center spray(s) 202 is turned on, i.e. the spray 46A and 46B and then after a suitable time delay, generally in the order of 10 seconds, the intermediate sprays 48A and 48B are simultaneously turned on as indicated at 204 and again after an appropriate time delay, generally in the order of 10 seconds, the outside sprays 50A and 50B are simultaneously turned on as indicated at 206. Again, after a time delay, generally in the order of 10 to 30 seconds, the coater head 16 is moved to preloaded position, i.e. moved from the position shown in FIG. 2 to the position shown in FIG. 3 wherein the stops 40 and 42 are in contact. In the FIG. 3 position, the metering rod 34 bears against the cover 22 (or 24) of the roll 12 (or 14) and applies pressure there against. The amount of pressure applied is dependent on the preload setting will be essentially the conventional preload setting currently used in the art which results in slight deformation of the cover 22 (or 20).

A suitable proximity switch or the like (not shown) is triggered as indicated at 212 by the coating head 32 being moved into the preloaded condition (i.e. with the stop 42 bearing against the stop 40) and coating feed pump (not shown) is turned on as indicated at 214. As this occurs, pneumatic pressure is applied to the tube 38 in a manner to gradually uniformly ramped up the air pressure within the tube 38 and thereby increase the pressure applied via rod 34 against the cover 22 (or 20) over a period of time generally in the order of 10 seconds. The ramp up of pressure in tube 38 is correlated with the ramp up of flow of coating fluid to the coating head(s) 32 so that there is no opportunity for a surge of coating flow out of the head before pressure is built up between the rod 34 and the roll 12 (or 14) to meter the coating flow, yet the pressure is not applied by the rod 34 against the roll 12 (or 14) so quickly that a disruption occurs that may damage the roll cover or cause web breakage. Generally, at least 5 seconds and preferably 10 to 25 seconds are used for ramp of flow pressure in tube 38 and the rate of increase in pressure is uniform. The coating flow may reach its maximum over a shorter time period but generally will require at least 3 preferably about 5 seconds.

On completion of the ramp up of pressure to the tube 38 and after a suitable delay of 10 to 30 seconds as indicated at 218, first the outside applicators 50A and 50B are turned off as indicated at 220, then, after a second time delay, again about 5 to 30 seconds, the intermediate applicators 48A and 48B are turned off as indicated at 222 and finally again, after a suitable time, the center applicators 46A and 46B are turned off as indicated at 224 and the proper coating application is then established. The actual sequence of turning off or on the sprays is not critical provided the action are symmetrically relative to the axis 52.

Obviously, the rolls 12 and 14 are rotating and the paper web is being fed through the nip at operating speed during the startup procedure.

It will be apparent from the above that by commencing the application of lubricating film from the center, i.e. equal amounts on opposite sides of the center line 52 and then symmetrically increasing the width of application along the axial length of the rolls on opposite sides of line 52 until substantially the full coating width has been lubricated, the paper is subjected to a high moisture content first at its center and gradually symmetrically relates to center line 52 working its way out to its side edges so that any deformation is balanced on opposite sides of the axial center line 52 and the alignment of the web 18 is not significantly altered nor is the web 18 subjected to other distortions.

The manner in which the coating head is mounted into position means that the web is not subject to any abrupt stress applications that are likely to cause web breakage.

Having described the invention, modifications will be evident to those skilled in the art without departing from the scope of the invention as defined in the appended claims.

What is claimed is:

1. A method of lubricating a surface of at least one size press roll comprising passing a paper web through a coater nip formed by said at least one size press roll, applying a lubricating liquid to a peripheral surface on said at least one size press roll along areas symmetrically located on opposite sides of an axial center line of said paper web passing through said nip to form on said peripheral surface of said at least one roll film lubricated areas symmetrically located on opposite sides of said axial center line, over time and symmetrically on opposite sides of said axial center line increasing the total width measured axially of said at least one roll of said lubricated areas until said lubricated areas extend axially of said at least one size press roll a width at least equal to an effective axial length of a coating head for application of a coating to said at least one roll, and then moving said coating head into coating positions against said at least one roll.

2. A method as defined in claim 1 wherein said at least one roll comprises a pair of size press rolls one forming one side of said nip and the other forming the other side of said nip and said lubricating film areas are symmetrically applied to each of said rolls and each of said pair of press rolls will have its said coating head which is moved into coating relationship with its said size press roll.

3. A method of lubricating the surfaces of a pair of size press rolls as defined in claim 2 wherein each said coating head includes a metering rod extending axially of said rolls and defining one side of a metering outlet from its respective said coating head through which coating is applied to said peripheral surface of its respective said roll and wherein said moving comprises a first step of preloading said metering rods against their respective peripheral surface and a second step following said first step and wherein each said rod is pressed against its respective said surface with greater force than when in said preloading position to position said head in final coating position.

4. A method of lubricating the surfaces of a pair of size press rolls as defined in claim 3 wherein in said second step pressure applied to said metering rod is gradually increased over a period of at least 5 seconds to move said metering rod into final coating position and is coordinated with a rate at which coating fluid is supplied to said coating head to ensure against application of too much coating by movement of said rod too slowly and disruption of the operation of said at least one roll by application of pressure of said metering rod too quickly.

5. A method of lubricating the surfaces of a pair of size press rolls as defined in claim 4, wherein said lubricating liquid is applied in a first stripe extending substantially equally on opposite sides of said axial center line of said web and said width is increased laterally in substantially equal increments and simultaneously on opposite sides of said first stripe until said lubricating film extends substantially said full effective axial length of said coating head on each said roll.

6. A method of lubricating the surfaces of a pair of size press rolls as defined in claim 3 wherein said lubricating liquid is applied in a first stripe extending substantially equally on opposite sides of said axial center line of said web and said width is increased laterally in substantially equal increments and simultaneously on opposite sides of said first stripe until said lubricating film extends substantially said full effective axial length of said coating head on each said roll.

7. A method of lubricating the surfaces of a pair of size press rolls as defined in claim 2, wherein said lubricating liquid is applied in a first stripe extending substantially equally on opposite sides of said axial center line of said web and said width is increased laterally in substantially equal increments and simultaneously on opposite sides of said first stripe until said lubricating film extends substantially said full effective axial length of said coating head on each said roll.

8. A method of lubricating the surface of a at least one size press roll as defined in claim 1 wherein said coating head includes a metering rod extending axially of said roll and defining one side of a metering outlet from said coating head through which coating is applied to said peripheral surface of said at least one roll and wherein said moving comprises a first step of preloading said metering rod against said surface of said at least one roll and a second step following said first step and wherein said rod is pressed against said surface with greater force than when in said preloading position step to position said head in final coating position.

9. A method of lubricating the surface of at least one size press roll as defined in claim 8 wherein in said second step pressure applied to said metering rod is gradually increased over a period of at least 5 seconds to move said metering rod into final coating position and coordinated with a rate at which coating fluid is supplied to said coating head to ensure against application of too much coating and disruption of the operation of said at least one roll by application of pressure of said metering rod too quickly.

10. A method of lubricating the surface of at least one size press roll as defined in claim 9 wherein said lubricating liquid is applied in a first stripe extending substantially equally on opposite sides of said axial center line of said web and said width is increased laterally in substantially equal increments and simultaneously on opposite sides of said first stripe until said lubricating film extends substantially said full effective axial length of said coating head.

11. A method of lubricating the surface of at least one size press roll as defined in claim 8 wherein said lubricating liquid is applied in a first stripe extending substantially equally on opposite sides of said axial center line of said web and said width is increased laterally in substantially equal increments and simultaneously on opposite sides of said first stripe until said lubricating film extends substantially said full effective axial length of said coating head.

12. A method of lubricating the surface of at least one size press roll as defined in claim 1 wherein said lubricating liquid is applied in a first stripe extending substantially equally on opposite sides of said axial center line of said web and said width is increased laterally in substantially equal increments and simultaneously on opposite sides of said first stripe until said lubricating film extends substantially said full effective axial length of said coating head.

* * * * *